US005522511A

United States Patent [19]

Sakoguchi et al.

[11] Patent Number: 5,522,511

[45] Date of Patent: Jun. 4, 1996

[54] BILL PROCESSING APPARATUS WITH BUNDLING MECHANISM

[75] Inventors: Yoshitaka Sakoguchi; Naoya Koike; Tsuyoshi Abe, all of Yokohama, Japan

[73] Assignee: Kabushiki Kaisha Toshiba, Kawasaki, Japan

[21] Appl. No.: 271,630

[22] Filed: Jul. 7, 1994

[30] Foreign Application Priority Data

Jul. 8, 1993 [JP] Japan ..... 5-169139
Dec. 28, 1993 [JP] Japan ..... 5-334385

[51] Int. Cl.[6] ..... B07C 5/00

[52] U.S. Cl. ..... 209/534; 209/900; 271/3.01; 902/12

[58] Field of Search ..... 209/534, 552, 209/900; 271/3.01, 9.01; 235/379; 902/12, 13

[56] References Cited

U.S. PATENT DOCUMENTS 5,000,322 3/1991 Goi ..... 209/534
5,247,159 9/1993 Yuge et al. ..... 209/534 X

FOREIGN PATENT DOCUMENTS 4275696 10/1992 Japan ..... 209/534
2094531 9/1982 United Kingdom ..... 209/534

*Primary Examiner*—William E. Terrell
*Assistant Examiner*—Tuan Nguyen
*Attorney, Agent, or Firm*—Cushman Darby & Cushman

[57] ABSTRACT

According to the bill processing apparatus of the present invention, the damage of bills picked one by one by the bill processing apparatus and the kind of bills are discriminated by a discriminating and judging section, and stacked in a stacking section by damaged and the kind of bills. The stacked bills are bundled by a predetermined number of bills by a binding unit, and stored in a predetermined safe. At this time, a mark is printed on the bundle of improper bills bundled by a predetermined number. Also, when the bundling state of the proper bills is not favorable, the form of the bundle of the proper bills is selected by a bundle form sensor, and stored in the same storing section as the case of the improper bills. Moreover, in dispensing each bundle, the bundling state of the bundle to be dispensed is checked by the bundle form sensor. Therefore, in a case that the bundle of the bills bundled by the predetermined number of bills is dispensed, only the bundle of the proper bills whose bundling state is within the regulated form is used.

3 Claims, 9 Drawing Sheets

BILL PROCESSING APPARATUS WITH BUNDLING MECHANISM

BACKGROUND OF THE INVENTION

1. Field of the Invention

The present invention relates to a bill processing apparatus, which has a bundling mechanism of bundling bills bundled by a predetermined number, and which can store the bundled bills and dispense the bills.

2. Description of the Related Art

In recent years, there has been proposed a bill processing apparatus with a bundling mechanism of bundling bills bundled by a predetermined number in addition to the function of counting the number of bills. The bill processing apparatus with bundling mechanism is disclosed in U.S. Pat. No. 5,247,159 filed on Sep., 21, 1993.

This type of bill processing apparatus has a bundling mechanism of bundling bills and a storage unit for storing the bundled bills.

In this case, even if there is a wad of bills which deviates from the specified form or only a wad of improper bills is included in many wads of bills, these bills are uniformly stored.

Therefore, the wad of bills bundled by a predetermined number must be visually selected by bank clerks or workers before the wad of bills is used again for dispensing. Due to this, there occurs a problem in that time for once taking up all wads of bundled bills from the apparatus to select the bills, a number of persons, which is necessary for the selection, must be ensured. Moreover, in a case that unfavorable wad of bills, which deviates from the regulated form of the bundled bills, is mixed, there is a possibility that the apparatus will be jammed with the wad of bundled bills in storing or dispensing the bills.

SUMMARY OF THE INVENTION

An object of the present invention is to provide a bill processing apparatus in which unfavorable wad of bills is detected and stored in another storing unit, whereby the selection of the wad of bills used for dispensing is not needed.

According to a first aspect of the present invention, there is provided a bill processing apparatus, comprising: means for picking up bills one by one; means for discriminating damage of the bill picked up by the picking up means; plurality of stacking means for sorting the bill discriminated by the discriminating means in accordance with the degree of damage of the bill to distinguish a proper bill to be used for dispensing between an improper bill not to be reused; means for bundling the bills stacked in the stacking means when a number of the stacked bills reaches to a predetermined number of bills; bundle form detecting means for detecting whether or not a form of bundle of proper bills bundled by the predetermined number by the bundling means is within a regulated form; a plurality of safes for storing the bundle of proper bills whose form is detected to be within the regulated form by the bundle form detecting means; and means for storing the bundle of improper bills and a bundle of proper bills whose form is detected to be out of the regulated form by the bundle form detecting means separately from the other bundle whose form is within the regulated form.

According to a second aspect of the present invention, there is provided a bill processing apparatus, comprising: means for picking up bills one by one; means for discriminating damage of the bill picked up by the picking up means and a kind of the bill; plurality of stacking means for sorting the bill discriminated by the discriminating means in accordance with the degree of damage of the bill to distinguish a proper bill to be used for dispensing between an improper bill not to be reused; means for bundling the bills stacked in the stacking means when the bills reaches to a predetermined number of bills; bundle form detecting means for detecting whether or not a form of bundle of proper bills bundled by the predetermined number by the bundling means is within a regulated form; a plurality of safes for storing the bundle of proper bills whose form is detected to be within the regulated form by the bundle form detecting means; and means for storing the bundle of improper bills and a bundle of proper bills whose form is detected to be out of the regulated form by the bundle form detecting means separately from the other bundle whose form is within the regulated form.

According to a third aspect of the present invention, there is provided a bill processing apparatus, comprising: means for picking up bills one by one; means for discriminating damage of the bill picked up by the picking up means and a kind of the bill; plurality of stacking means for sorting the bill discriminated by the discriminating means in accordance with the degree of damage of the bill to distinguish a proper bill to be used for dispensing between an improper bill not to be reused; bundling means for bundling the bills stacked in the stacking means when the bills reaches to a predetermined number of bills; first bundle form detecting means for detecting a form of bundle of proper bills bundled by the predetermined number by the bundling means; a plurality of safes for storing the bundle of proper bills by kind of bills whose form is detected to be within the regulated form by the first bundle form detecting means; means for storing the bundle of improper bills and a bundle of proper bills whose the form is detected to be out of the regulated form by the first bundle form detecting means separately from the other bundle whose form is within the regulated form; means for dispensing the bundle of the proper bill from the safe to be dispensed; second bundle form detecting means for detecting the form of the bundle of the proper bill dispensed by the dispensing means; and receiving and transporting means for receiving the bundle of the proper bills dispensed by the dispensing means and detected as a normal form by the second bundle form detecting means, and for transporting the bundle of the proper bills to a predetermined position.

According to a fourth aspect of the present invention, there is provided a bill processing apparatus wherein bills sorted by a predetermined number are bundled and the bundled bills can be dispensed, comprising: means for holding bills to be sorted; means for picking up the bills held on the holding means one by one; means for discriminating damage of the bill picked up by the picking up means and a kind of the bill; first stacking means for stacking the bill or proper bill discriminated to be suitable for a next use at a market by the discriminating means; second stacking means for stacking the bill or improper bill discriminated to be unsuitable for a next use at a market by the discriminating means; means for bundling the bills stacked in each of the first and second stacking means when the bills reaches to a predetermined number of bills; first bundle form detecting means for detecting a form of bundle of proper bills bundled by the predetermined number by the bundling means; a plurality of safes for storing the bundle of proper bills by kind of bills whose form is detected to be within the regulated form by the first bundle form detecting means; means for storing the bundle of improper bills and a bundle of proper bills whose the form is detected to be out of the regulated form by the first bundle form detecting means separately from the other bundle whose form is within the regulated form; means for dispensing the bundle of the proper bill from the safe to be dispensed; second bundle form detecting means for detecting the form of the bundle of the proper bill dispensed by the dispensing means; transporting means, provided at inlet/outlet of each of the safes to be opened/closed, for introducing the bundle of bills being delivered at present into the corresponding safe when the kind of the bundle of bills being delivered at present is conformed to each of the safes and the form is detected to be within the regulated form by the first form detecting means, and for guiding the bundle of bills being delivered at present to the storing means when the form of the bundle of bills being delivered at present is detected to be out of the regulated form by the first form detecting means; and receiving means for receiving the bundle of the proper bills dispensed by the dispensing means and detected as a normal form by the second bundle form detecting means; and control means for driving the transporting means to each of the bundles of bills is dropped into the storing means when the bundle of bills bundled by the bundling means is a bundle of improper bills, the form of the bundle of the bills transported to the plurality of safes is detected to be out of the regulated form by the first form detecting means, and the form of the bundle of bills transported to the receiving means from the plurality of safes is detected to be out of the regulated form by the second form detecting means, and for transporting a next bundle of bills to the receiving means from the one of plurality of safes when the bundle of the bills dropped into the storing means is a bundle transported to the receiving means from one of the plurality of safes.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENT

An embodiment of the present invention will be explained with reference to the drawings.

Figure 1:
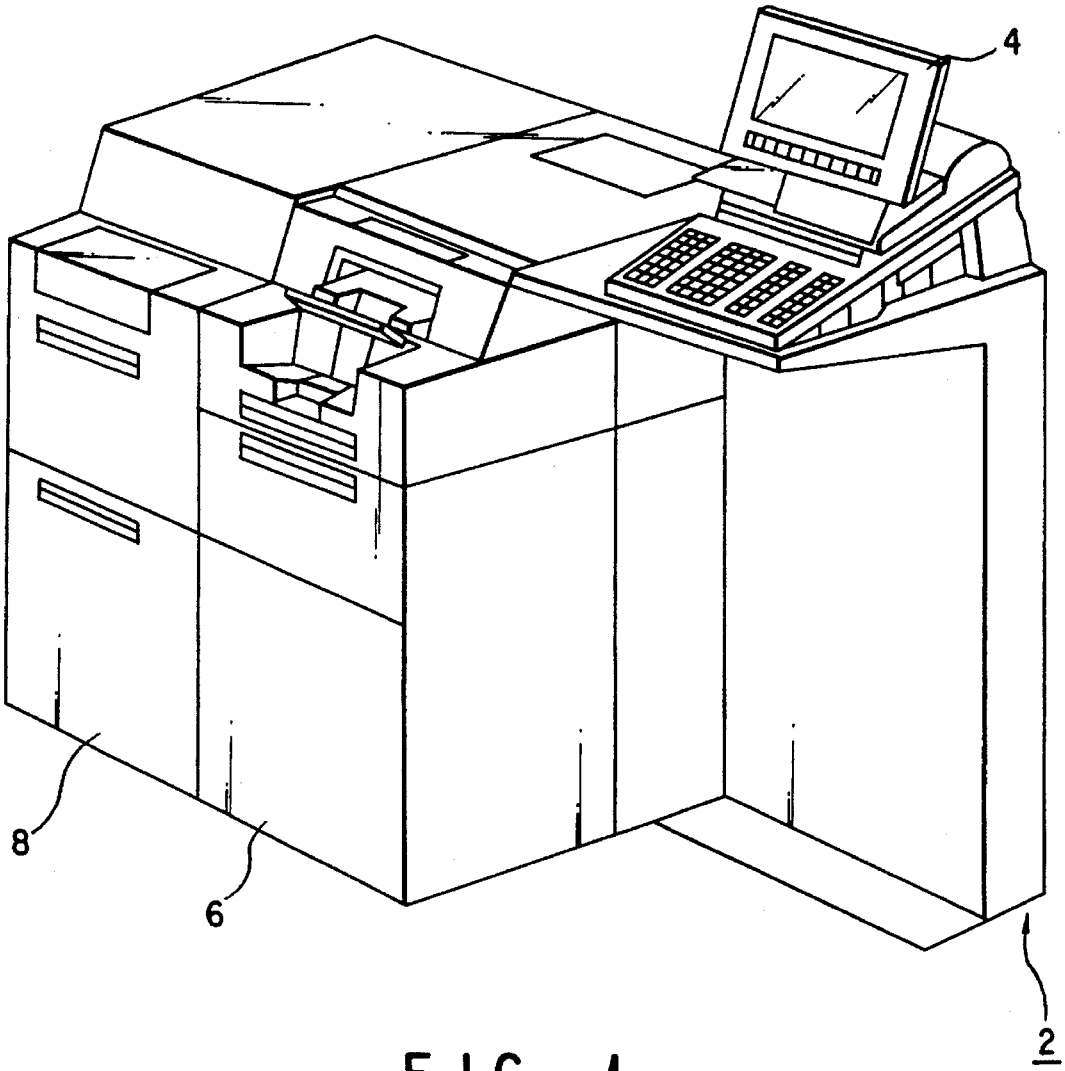
FIG. 1 is a schematic view of a bill processing apparatus into which an embodiment of the present invention is incorporated.

FIG. 1 shows the outline of a bill processing apparatus 2.

The bill processing apparatus 2 has an operating section 4 including a console panel (input panel) and a display device, a bill processing section 6 for discriminating and counting bills based on data inputted through the operating section 4, and a bundling storing section 8 for binding the bills discriminated/counted by the bill processing section 6, for forming a bundle of bills in which a predetermined number of bills is bundled, and for storing the bundle of bills in accordance with a kind of bills.

The operating section 4 provides an instruction of a predetermined operation to bill processing section 6 and the bundling storing section 8.

Figure 2:
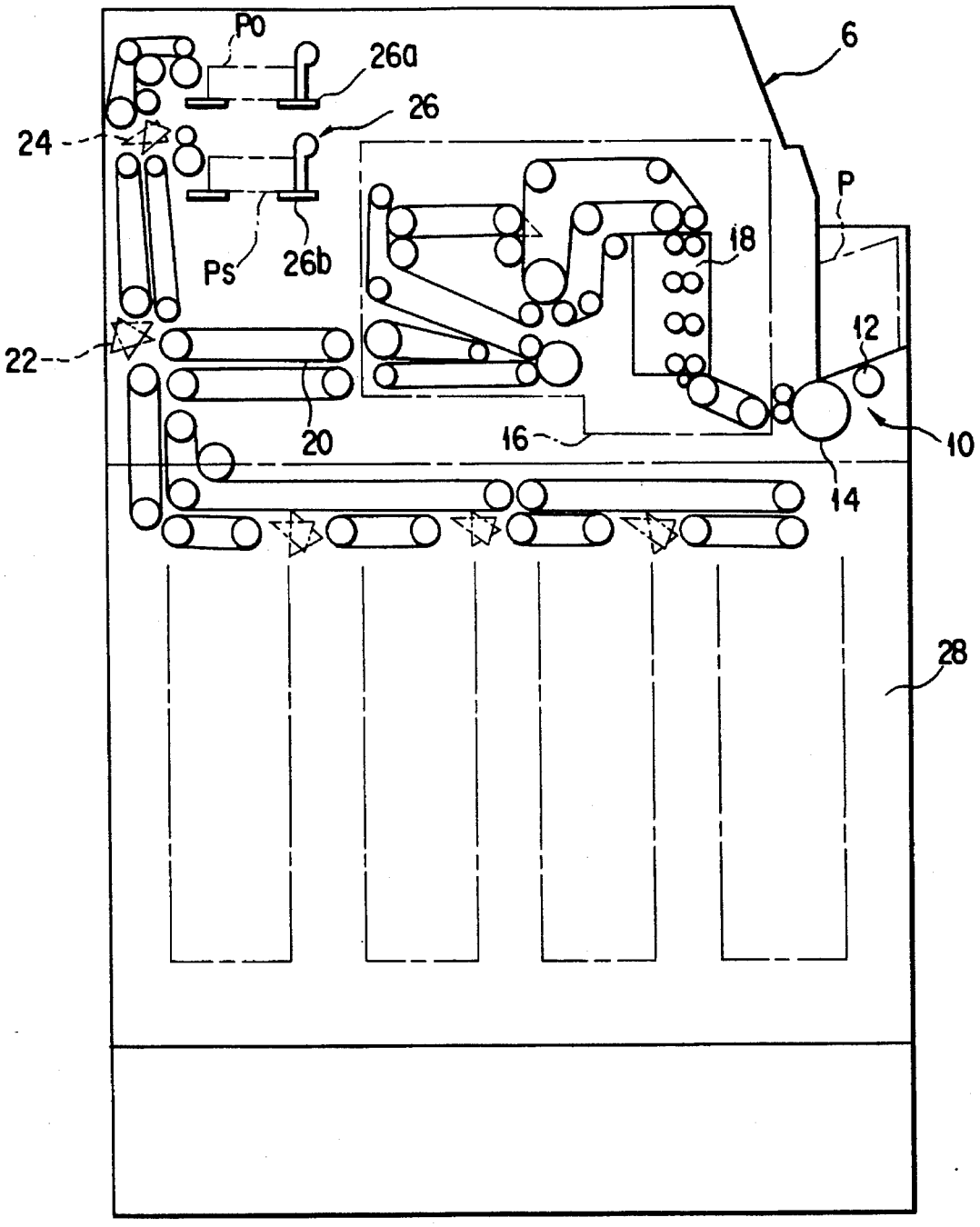
FIG. 2 is a schematic cross sectional view of the bill processing apparatus of FIG. 1.
Figure 3:
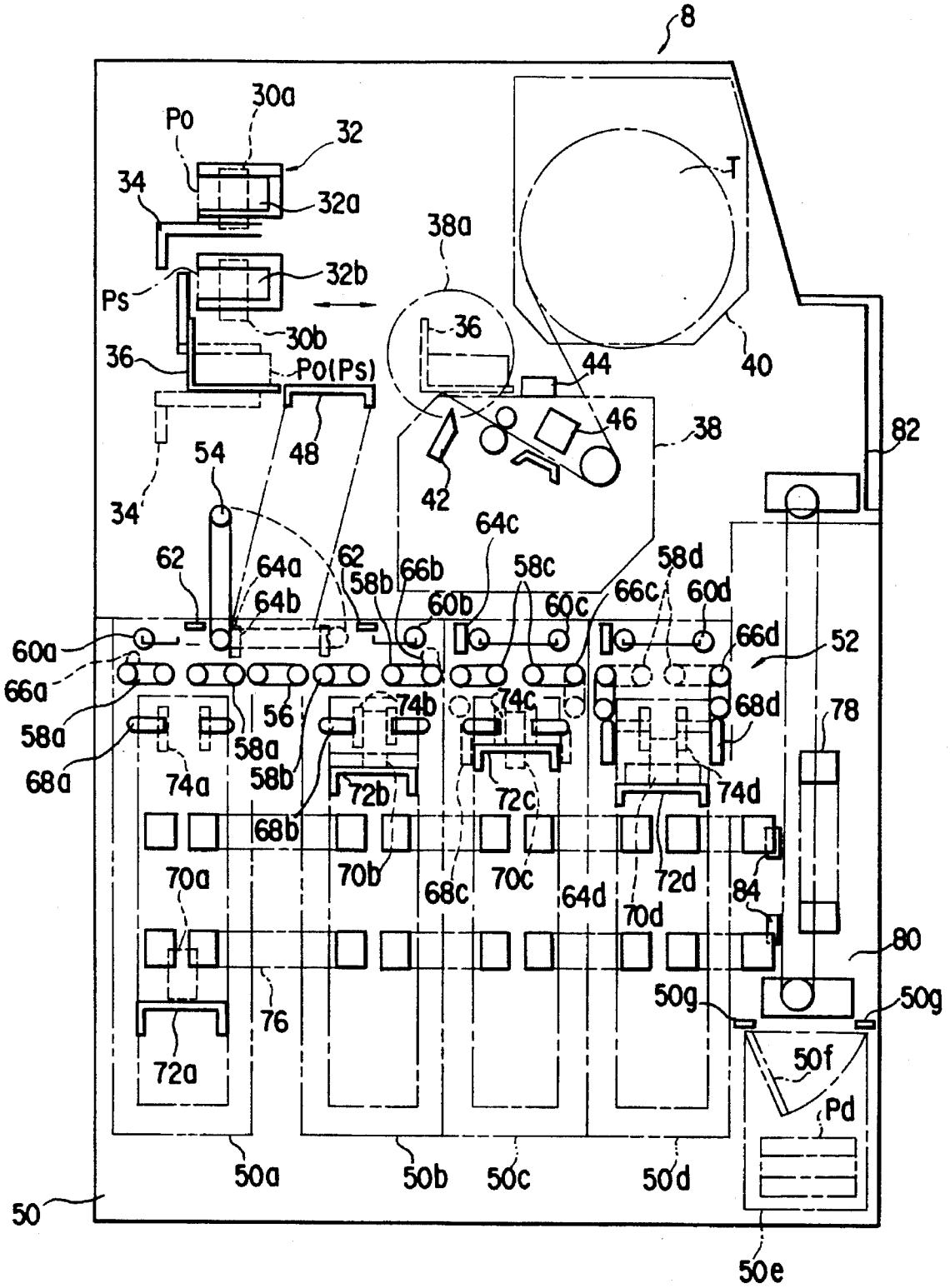
FIG. 3 is a binding storing section of the bill processing apparatus of FIG.

FIGS. 2 and 3 show cross sectional views of the bill processing section 6 and the bundling storing section 8, respectively.

In FIG. 2, the bill processing section 6 includes a picking-up unit 10 on which bills to be counted and discriminated are mounted, a separation roller 12 provided at a lower portion of the picking-up unit 10, and a picking-up roller 14. Also, the bill processing section 6 has a discriminating and judging section 16 for discriminating the bills, which is set in the picking-up unit 10 and carried by the separation roller 12 and the picking-up roller 14, in view of the kind of bills (face value of bills), degree of damage of bills, and the truth or falsehood of the bills. The discriminating and judging section 16 is formed integrally with a transporter 18. The section 16 reads the kind of bills, degree of damage of bills, and the truth or falsehood of the bills, which are supplied from the picking-up unit 10 by a transfer roller or a transfer belt (both not shown), and supplies the bills to a conveyer 20. The bills supplied to the conveyer 20 are carried to either a predetermined stacking portion or a stock yard through first and second pass-change-over gates 22 and 24.

The bill processing section further includes a stacking portion 26 and a stock yard 28. The stacking portion 26 stacks the predetermined number of bills, which is carried from the conveyer 20, at one time. The stock yard 28 stocks the kind of bills, degree of damage and genuineness are discriminated by the discriminating and judging section 16 in a lump sum (in a non-bundled state). In this case, the damage of bills shows whether or not the bills can be withstood in the next use on the market, in other words, degree of dirty or breakage of bills.

When a storage command is inputted from the operating section 4, the bills mounted on the picking-up unit 10 are sent to the discriminating and judging section 16 through the rollers 12 and 14 in order. The discriminating and judging section 16 is formed integrally with the transporter 18, discriminates the kind of bills, degree of damage of bills, and the truth or falsehood of the bills, and supplies the bills to a conveyer 20.

The bills supplied to the conveyer 20 are carried to either the stacking portion 26 or the stock yard 28 through the first and second pass-change-over gates 22 and 24. The stacking portion 26 has a first stacking portion 26*a* in which proper bills are stacked, and a second stacking portion 26*b* in which improper bills are stacked. By driving the second pass-change-over gate 24 in accordance with data of the bills obtained by the discriminating and judging section 16, the proper bills and improper bills are stacked in the first and second stacking portions 26*a* and 26*b*, respectively. The first and second stacking portions 26*a* and 26*b* are independently movable. Moreover, the first and second portions 26*a* and 26*b* move the plurality of bills stacked in each portion to the bundling storing section 8.

In FIG. 3, the bundling storing section 8 includes a pair of robot hands (bill handling mechanism) 30*a* and 30*b* for receiving the bills, which are counted by a predetermined number of bills to be transported through the first and second portions 26*a* and 26*b* of the bill processing section 6, and a temporarily stacking section 32 storing the bills moved from the first and second portions 26*a* and 26*b* by the robot hands 30*a* and 30*b* when the robot hands 30*a* and 30*b* temporarily retreat. The temporarily stacking section 32 has first and second temporarily stacking sections 32*a* and 32*b* corresponding to the proper and improper bills sent from the bill processing section 6. In the temporarily stacking section 32, there are arranged a backup plate 34 for sending the predetermined number of bills transported through the robot hands 30*a* and 30*b* in upper and lower directions, and a carrier 36 for transporting the predetermined bundle of bills picked up from the temporarily stacking section 32 through the backup 34 toward a tape field unit 38 (to be described later).

The tape field unit 38 is included in the bundling storing section 8 so as to bind the bills stored in the temporarily stacking section 32. The tape field unit 38 has a bundling unit 38*a*, which draws a binding tape T stored in a tape holder in advance and binds the predetermined number of bills transported through the carrier 36, a cutter 42, which cuts the tape T drawn in the bundling unit 38*a* to a predetermined length, a heater 44, which heats the binding tape T for adherence, and a print unit 46, which prints a predetermined character or marks onto the binding tape T.

The bundle of bills, which are bundled by the predetermined number, is carried to a storage device 50 through a vertical carrier 48.

The storage device 50 has first to fourth safes 50*a*, 50*b*, 50*c*, and 50*d*, which store bundles of proper bills for by kind, which are bundles by the predetermined number through the tape field unit 38, an improper bill storing safe 50*e*, which stores the bundles of improper bills, and a depositing bundles transporter 52, which transports the bundles of bills transported through the vertical carrier 48. On the upper portion of the improper bill storing safe 50*e*, there are provided a cover 50*f*, which is rotatably formed, and a discharging sensor 50*g*, which detects that the bundle of improper bills to be stored in the storing safe 50*e* is passed.

The depositing bundles transporter 52 includes a clamping and conveying mechanism 54, which moves the bundles received from the vertical carrier 48 in the direction of any of safes 50*a* to 50*d* and or improper bill storing safe 50*e*, and a clamping and guiding roller 56, which is placed opposite to the clamping and conveying mechanism 54 and guides the bundles in cooperation with the clamping and conveying mechanism 54. The clamping and conveying mechanism 54 is rotatably provided in a state that the side of the depositing bundle is used as a fulcrum. At the time when the vertical carrier 48 is moved down, the mechanism 54 is put over the vertical carrier 48, and the bundle mounted on the vertical carrier 48 is moved in a predetermined direction. The clamp guide roller 56 is formed to be partially exposed to a contact surface with the bundle of the vertical carrier 48, so that the bundle mounted on the vertical carrier 48 is guided to the depositing bundles transporter 52 without difficulty.

On the upper portion of the respective safes 50*a* to 50*d*, which is a part of the depositing bundles transporter 52, there are provided pushing and conveying shutters 58*a* to 58*d* and upper guiding elements 60*a* to 60*d*. The pushing and conveying shutters 58*a* to 58*d* further convey the bundles carried from the clamping and conveying mechanism 54 and the clamping guide roller 56. The respective upper guiding elements 60*a* to 60*d* are arranged to be opposite to the respective shutters 58*a* to 58*d*, so that a passage where the bundles are passed is formed by these upper guiding elements 60*a* to 60*d* and the shutters 58*a* to 58*d*.

Each of the shutters 58*a* to 58*d* is formed to be paired with other, that is, a pair of shutters 58*a*, a pair of shutters 58*b*, a pair of shutters 58*c*, and a pair of shutters 58*d*. Moreover, these shutters 58*a* to 58*d* are formed to be rotatable in a direction perpendicular to the outer wall of each of the safes and a direction parallel thereto in a state that the outer wall side of the safes 50*a* to 50*d* is used as a fulcrum. At both ends of the clamping and conveying mechanism 54, there are provided bundle form sensors 62 (first detecting means) for detecting a bundle form of the bundled bills transported through the vertical carrier 48. Moreover, one of the respective paired shutters 58*a* to 58*d*, that is the positioned at a side away from the clamping and conveying mechanism 54, there are provided gate stoppers 66*a* to 66*d* for storing the corresponding bundles in the safes 58*a* to 58*d* designated in accordance with the instruction sent from the operating section 4, and bundle end detectors 64*a* to 64*d* for detecting the final end portion of the bundle conveyed by the shutters 58*a* to 58*d*.

At the lower portion of each of the shutters 58*a* to 58*d* arranged to correspond to the first to fourth safes 50*a* to 50*d* (that is, an upper portion of each of the safes 50*a* to 50*d*), stoppers 68*a* to 68*d* for temporarily stopping the bundle are rotatably provided, respectively. Moreover, in the safes 50*a* to 50*c*, there are arranged dispensing bundle picking up elements 70*a* to 70*d*, bases 72*a* to 72*d*, and dispensing bundle picking up rollers 74*a* to 74*d*. The dispensing bundle picking up elements 70*a* to 70*d* move a predetermined bundle of bills to the outside of the safes in order to dispense bills. The level of each of the bases 72*a* to 72*d* is changed in accordance with the amount of the stored bundles. The dispensing bundle picking up elements 74*a* to 74*d* rollers are used to convey the bundles moved through the picking up elements 70*a* to 70*d* to a dispensing bundles transporter 76 (to be explained later). The dispensing bundles transporter 76 is provided at the side surface of each of the first to fourth safes 50*a* to 50*d* so as to convey the bundle picked up from each of the safes 50*a* to 50*d* through the respective picking up elements 70*a* to 70*d* by the input of the operating section 4.

At the position, which is the upper portion of the safe 50*e* where the bundles conveyed from the dispensing bundle transporter 76 are detached therefrom, there are provided a lifter 78, which moves the dispensed bundles to a stacking portion of an elevator 80 (to be explained later), and the elevator 80, which moves the bundles stacked by the lifter 78 to a dispensing portion (to be explained later).

Moreover, at a portion, which is between the dispensing bundles transporter 76 and the lifter 78, and which does not prevent the movement of the elevator 80, there is provided a dispensing bundle form sensor (detecting means) 84, which detects the bundle form just before the bundles, which are picked up from each of the safes 50*a* to 50*d* and conveyed by the dispensing bundles transporter 76, are conveyed to the lifter 78. The function of the sensor 84 is the same as that of the sensor 64.

Figure 4:
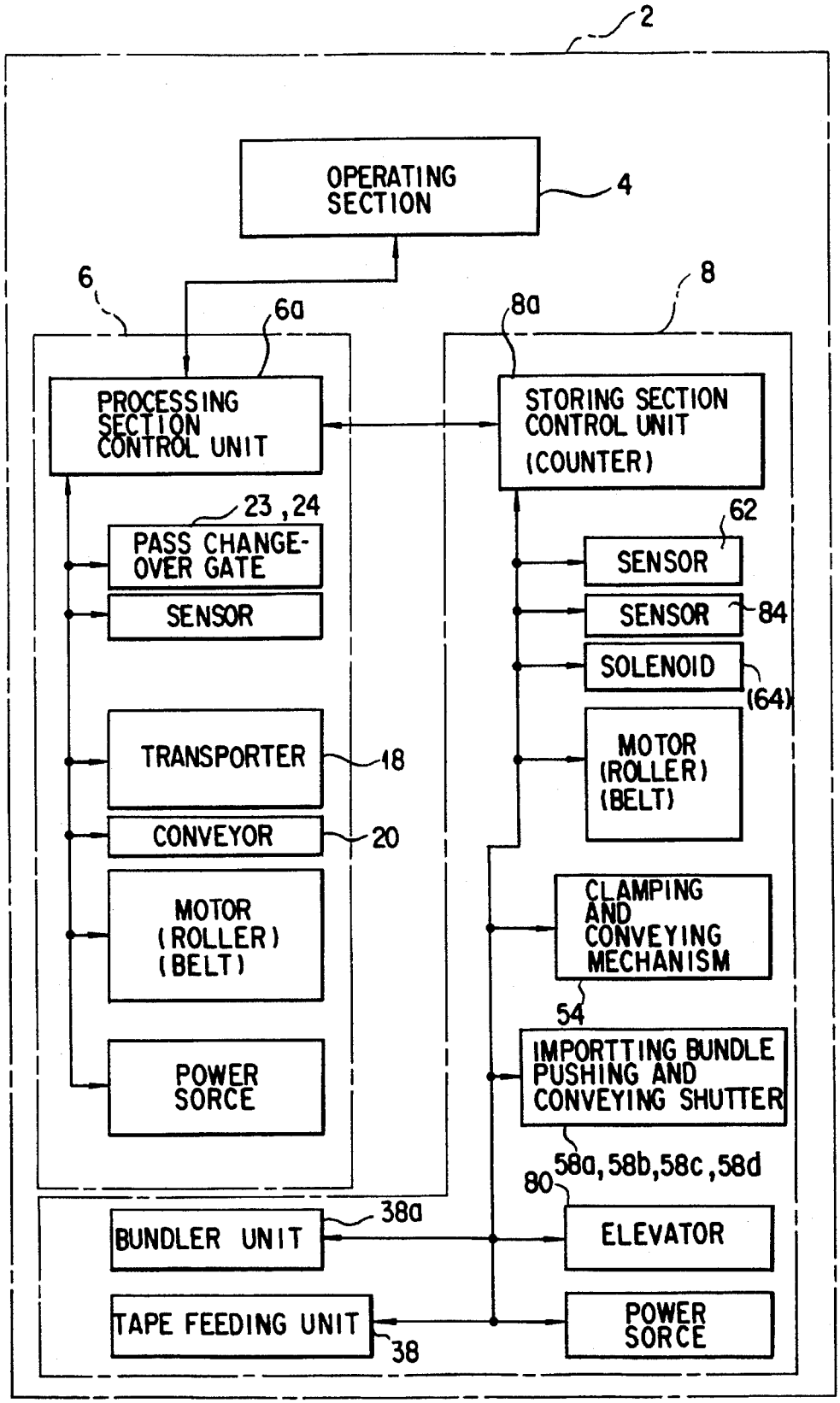
FIG. 4 is a block diagram of the bill processing apparatus of FIG. 1.

FIG. 4 is a schematic block diagram showing the bill processing section 6 of FIG. 2 and the bundling storing section 8 of FIG. 3.

In FIG. 4, the operating section 4 of the bill processing apparatus 2 is connected to the processing section control unit 6*a* of the bill processing section 6. The control unit 6*a* of the bill processing section 6 is mutually connected to the bundling storing section control unit 8*a* of the bundling storing section 8. The transporter 18, the conveyer 20, the first and second pass-change-over gates 22 and 24, the sensors, and the motor connecting rollers and belt are controlled by the control unit 6*a*. Each of the items and the control unit 6*a* are energized by the power supply section. The bundler unit 38*a*, the tape feeding unit 38, the clamping and conveying mechanism 54, the importing bundle pushing and conveying shutter 58*a* to 58*d*, the sensors 62 and 84 the elevator 80, and the motor connecting rollers and belt are controlled by the control unit 8*a*. Each of the items and the control unit 8*a* are energized by the power supply section.

Figure 5:
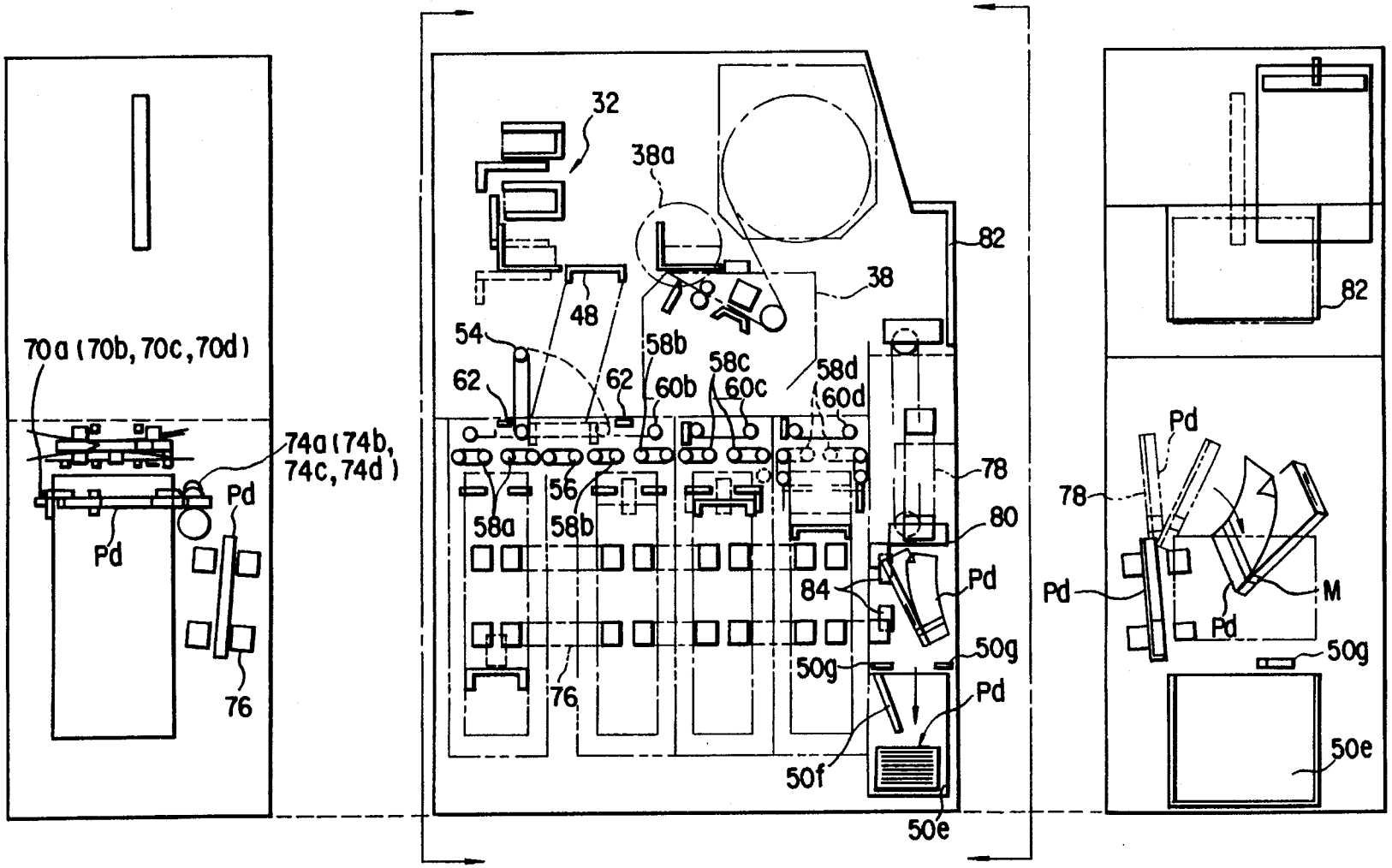
FIG. 5 is a schematic view showing one example of an operation of the bill processing apparatus of FIG. 1.

FIG. 5 is a schematic view showing one example of an operation of the bundling storing section 8 of FIG. 3.

By inputting the storage command from the operating section 4, the bills mounted on the picking-up unit 10 are sent to the discriminating and judging section 16 from the bill of the lowest portion in order through the separation roller 12 and the picking-up roller 14.

The discriminating and judging section 16 discriminates the kind of bills supplied from the picking-up unit, degree of damage of bills, and the truth or falsehood of the bills, and the discriminated bills are conveyed to either stacking portion 26 or the stock yard 28 through the conveyer 20 and the pass-change-over gate 22.

If the number of proper bills Po of the first stacking portion 26*a* is 100, the proper bills Po are moved through the first stacking portion 26*a* to the bundling storing section 8 from the bill processing section 6.

The proper bills Po are clamped by the robot hand 30*a*, and moved onto the backup 34. Under this state, the robot hand 30*a* is released, the proper bills Po are moved onto the backup 34, and the robot 30*a* retreats to the retreat position A. The backup 34 on which the proper bills Po are mounted is moved down to the carrier 36, and moved by the carrier 34.

Sequentially, the carrier 36 is moved to the unit 38*a* of the tap feeding unit 38, and the proper bills Po are bundled with a binding tape T drawn from a tape holder 40. In this case, the binding tape T is cut to a predetermined length by the a cutter 42, at least one end of the tape T is heated by the heater 44, thereby the adhesion of the tape is made. Moreover, a date or a name of a branch office is printed on a predetermined position of the tape by the printer 46.

The predetermined number of the bills are bundled by the bundling unit 38*a*. The bundle is returned from the bundling unit 38*a* by the carrier 36, and moved by the vertical carrier 48.

At this time, the vertical carrier 48 is moved down, and connected onto the clamping and guiding roller 56 of the depositing bundle transporter 52 of the storage device 50. At the same time, the clamping and conveying mechanism 54 is moved to the position B, and the bundle of the proper bills Po can be conveyed to a predetermined safe.

For example, when the bundle of the proper bills Po is stored in the fourth safe 50*d*, the bundle moved onto the clamping and guiding roller 56 is moved to the safe 50*d* by the clamping and conveying mechanism 54.

Sequentially, the bundle is passed through the conveying shutter 58*b* and the bundle form sensor 62 detects whether the bundle form is within the regulated form. In a case that the bundle form is within the regulated form, the bundle is conveyed to the shutters 58*c* and 58*d* in order, and stopped by the gate stopper 66*d*. When the bundle of the proper bills Po is passed through the bundle end detector 64*d*, the gate stopper 66*d* is projected to the passage, which is formed by the shutter 58*d*, by a solenoid (not shown). When the shutter 58*d* is rotated, the bundle of the proper bills Po, which is stopped on the safe 50*d* by the gate stopper 66*d*, is moved onto the stopper 68*d* of the safe 50*d* and mounted on the base 72*d* of the safe 50*d*, and stored in the safe 50*d*. More specifically, the bundle of the proper bills Po moved onto the stopper 68*d* is dropped into the safe 50*d* by rotating the shutter 58*d*. It is of course that each of the shutter 58*d* and stopper 68*d* is not returned to the original state at the time when the bundle of the proper bills Po is dropped into the safe 50*d*. In a case that a predetermined safe is filled with the bundles of the proper bills Po, that is, there is no room to store bundles in the safe, the bundle is stored in the safe 50*e* for improper bills even if the bundle is the bundle of the proper bills Po.

On the other hand, if a predetermined number of improper bills Ps of the second stacking portion 26*b* reaches 100, the improper bills Ps are moved by the second stacking portion 26*b*, and conveyed to the bundling storing section 8 of the bill processing section 6 similar to the case of the proper bills Po. The improper bills Ps are clamped by the robot hand 30*b*, and moved onto the backup 34. Then, the improper bills Ps are bundled by the bundling unit 38*a* in the same process as the case of the proper bills Po. In this case, an improper bill mark M denoting the bundle of the improper bills Ps is printed on the tape T by the printer 46.

The bundle of the improper bills Ps is moved to the vertical carrier 48 through the carrier 36, and mounted on the clamping and guiding roller 56. At this time, the clamping and conveying mechanism 54 is driven to the position B, and the passage of the depositing bundle transporter 52 is formed. The bundle of the improper bills Ps is conveyed to the safe 50*e*. In this case, since it is clear that the bundle being transported is the improper bills Ps stacked on the second stacking portion 26*b* in accordance with the control of the storing section control unit 8*a*, the output of each of the sensor 62, sensors 64*b* to 64*d* is cancelled, and the bundle is directly stored in the safe 50*e*.

Figure 6:
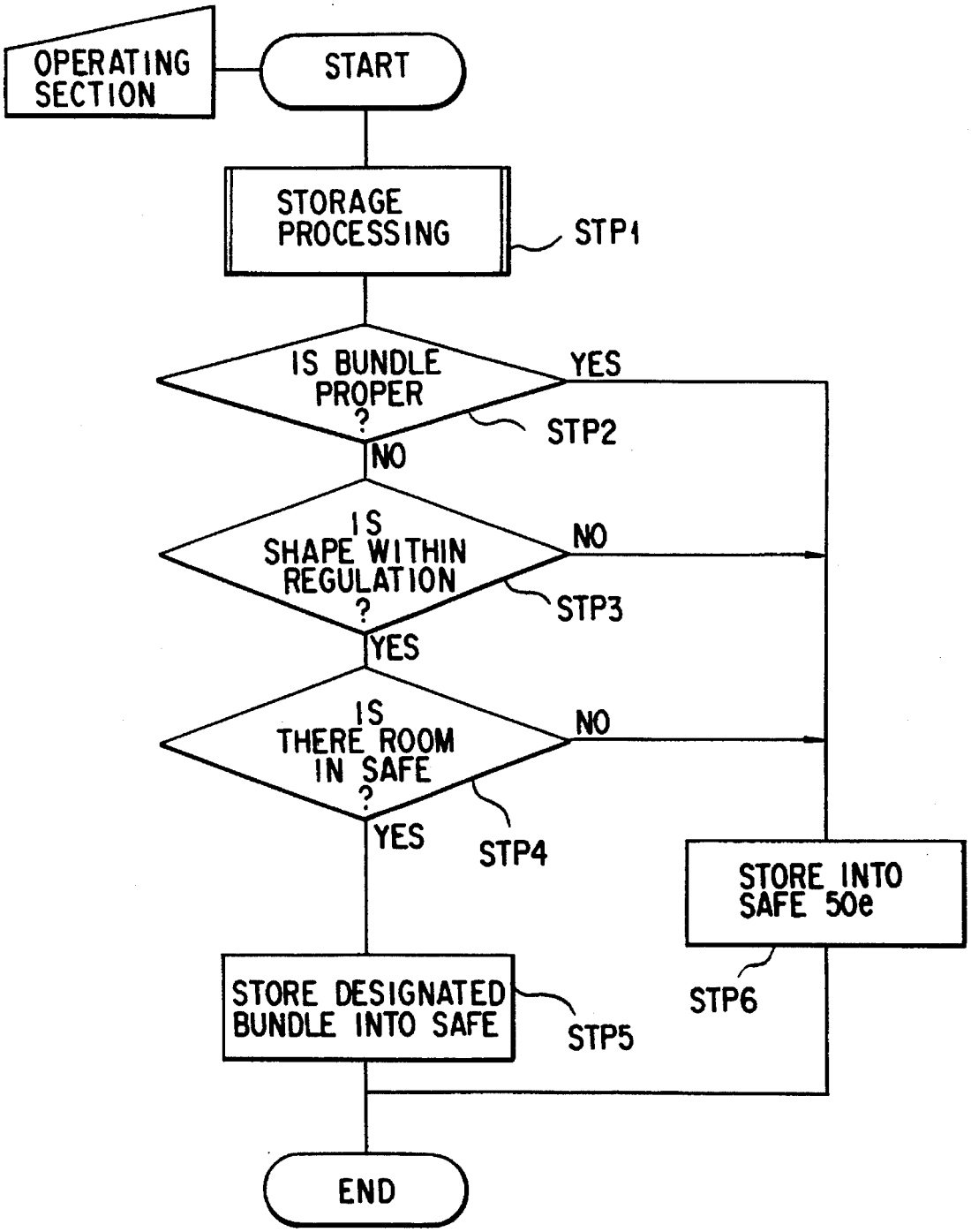
FIG. 6 is a flow chart showing the operation of the bill processing apparatus shown in FIG. 5.

More specifically, as shown in FIG. 6, in accordance with the instruction from the operating section 4, a storage processing mode is defined (STP1). Thereafter, it is discriminated whether binding bills are proper bills Po or improper bills Ps (STP2).

If the binding bills are proper bills Po (STP2-N), it is discriminated whether or not the form of the bundle in which a predetermined number of bills are bundled is within the regulated form (STP3).

If it is discriminated that the form of the bundle is within the regulated form (STP3-Y), it is checked whether or not the proper bill safe, which corresponds to the kind of bills of the storage device 50, is filled with the bundles of the proper bills (STP4). If there is a room in the corresponding proper bill safe (STP4-Y), the bundle of bills is stored in the designated proper bill safe (STP5). Also, if there is no room in the corresponding proper bill safe (STP4-N), the bundle of bills is stored in the improper bill storing safe 50*e* (STP6).

If the binding bills are improper bills Ps (STP2-Y), the output of each of the sensor 62, sensors 64*b* to 64*d* is ignored, and the bundle is directly stored in the safe 50*e*.

Figure 7:
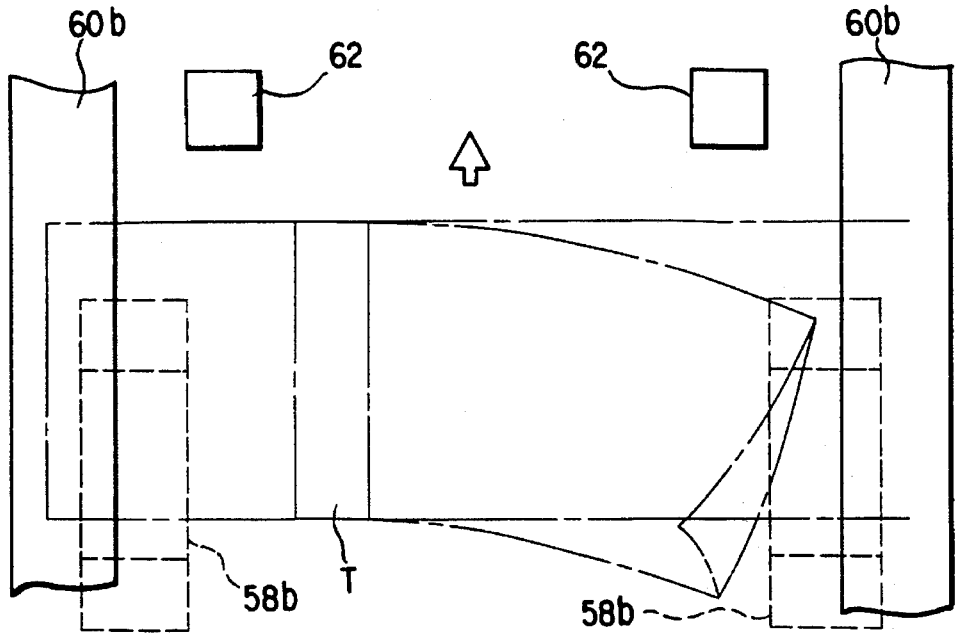
FIG. 7 is a schematic plane view showing a method for detecting the binding state in the bill processing apparatus shown in FIG. 1.

FIG. 7 schematically shows a method for detecting the bundle state (form of the bundle) of the bills (proper bills) by the bundle form sensor 62.

In FIG. 7, the bundle in which a predetermined number of bills Po are bundled is conveyed to any one of the safes 50*b* to 50*d* through the shutters 58*b* to 58*d*. Since the upper guiding element 60*b* is provided on the upper portion of the shutter 58*b*, the bundle of the bills Po is moved at substantially a constant speed. Therefore, passing time relating to the width direction of the bundle is detected by the sensor 62 provided between the shutter 58*b* and the clamping and guiding roller 56, so that the bundle form of the proper bills Po directing to any one of the safes 50*b* to 50*d* is detected.

In this case, if it is discriminated by the sensor 62 that the bundle form of the proper bills is out of the regulated form, the bundle is sequentially conveyed to the depositing bundle transporter 52 without being stopped by the gate stopper 66*d*, and stored in the safe 50*e* as a defective bundle form Pd.

Figure 8:
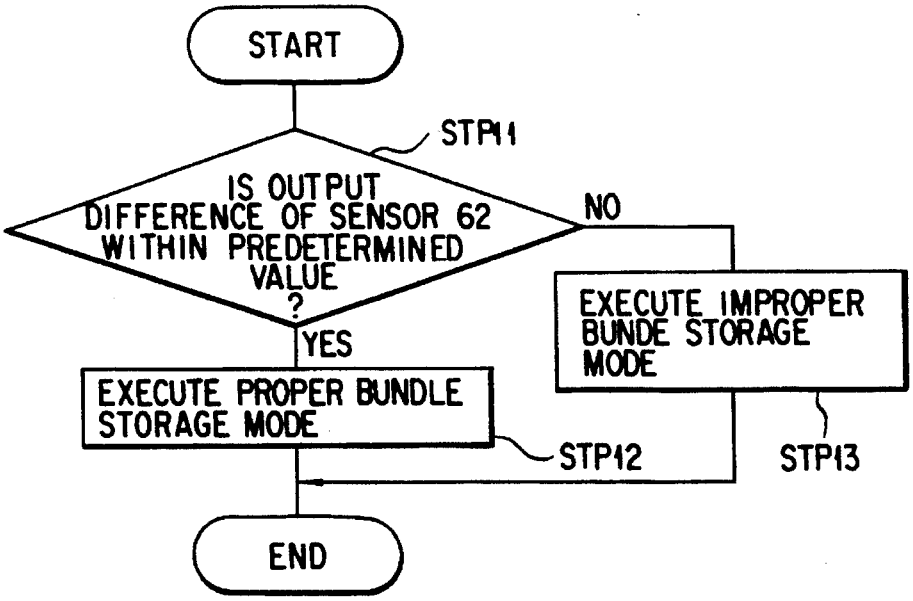
FIG. 8 is a flow chart showing an operation of detecting the binding state in the bill processing apparatus shown in FIG. 7.

More specifically, as shown in the flow chart of FIG. 8, it is discriminated whether or not passing time is within the regulated value (predetermined value) (STP11). In this case, two sensors 62 are provided to have a distance in the longitudinal direction of the bundle of proper bills Po. Due to this, if a difference in the passing time detected by each sensor 62 is within a predetermined value (STP11-Y), the proper bill storage mode is executed (STP12). If the difference in the passing time detected by each sensor 62 exceeds the predetermined value (STP11-N), the improper bill storage mode is executed (STP12).

Figure 9:
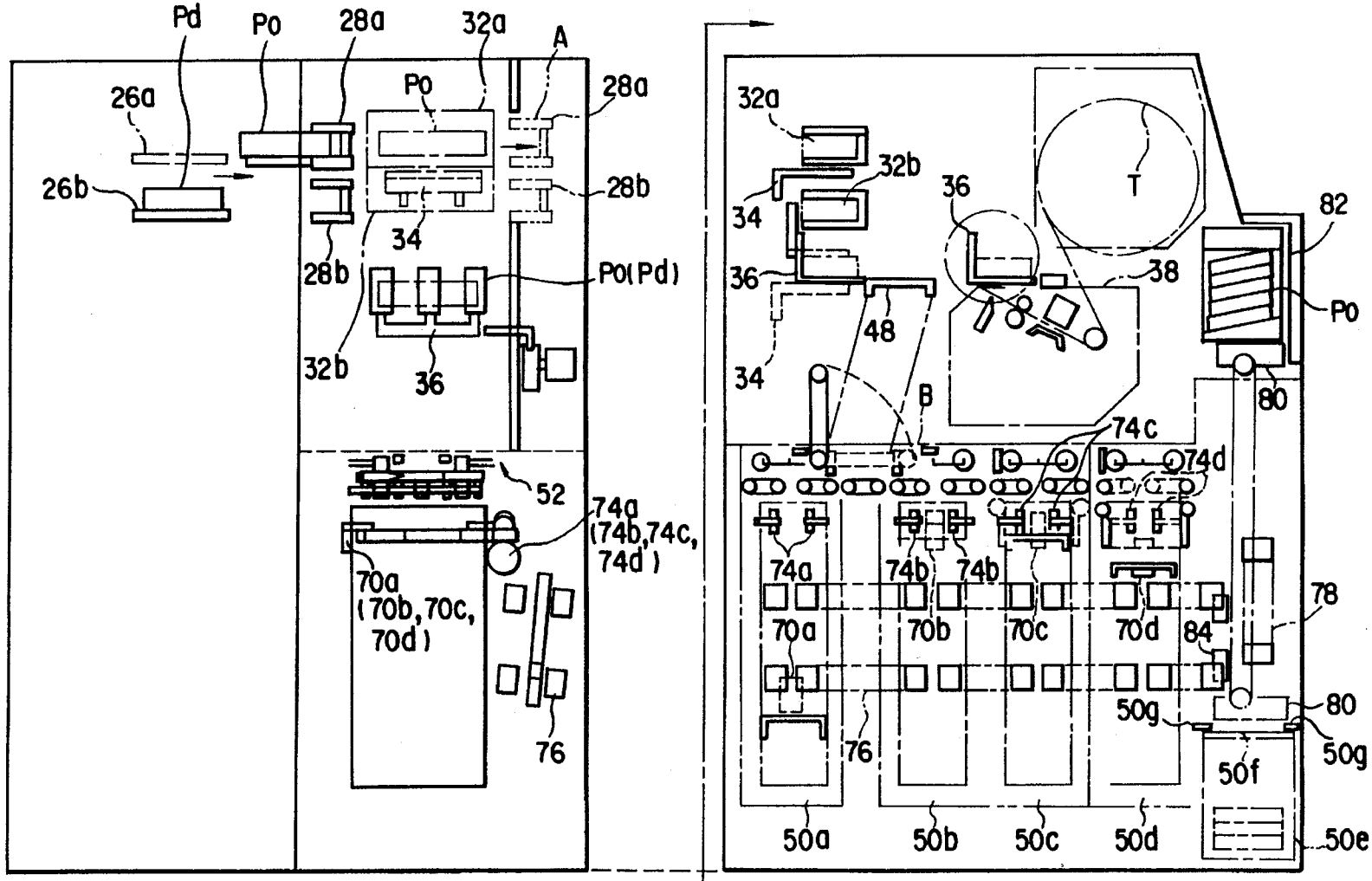
FIG. 9 is a schematic view showing one example of an operation of dispensing bills in the bill processing apparatus of FIG. 1.
Figure 10:
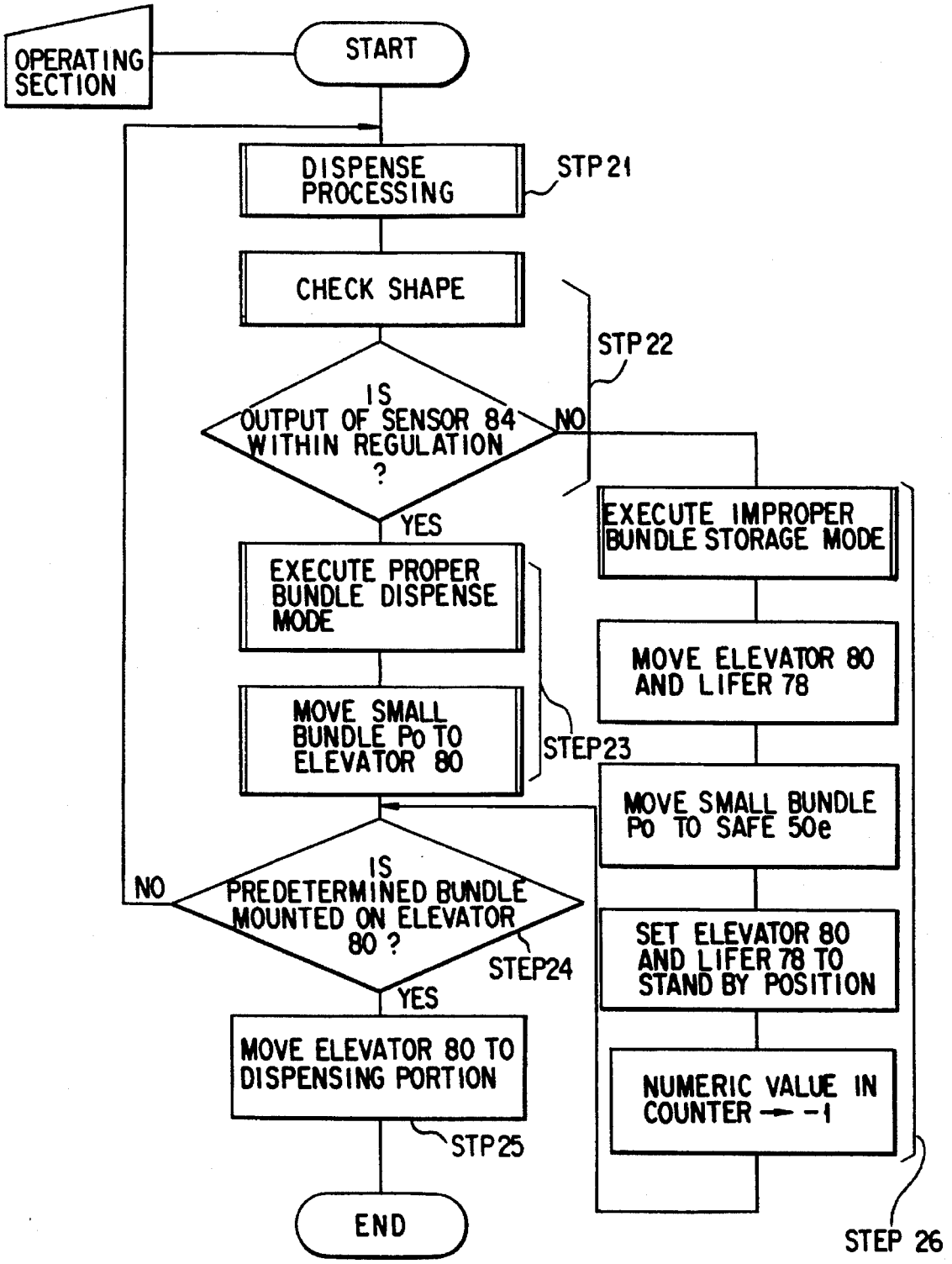
FIG. 10 is a flow chart showing an operation of detecting the binding state when dispensing bills in the bill processing apparatus shown in FIG. 9.

FIGS. 9 and 10 shows an example in which the bundle of bills stored in the storage device 50 is dispensed.

The bundles of the proper bills Po stored in each of the first to fourth safes 50*a* to 50*d* are pressed out from the safes sequentially from the bundle of proper bills Po positioned at the uppermost portion of the bases (72*a* to 72*d*). The bundles pushed outside of the safes are moved to the dispensing bundle transporter 76 through the dispensing bundle picking-up rollers (74*a* to 74*d*).

The bundle moved to the transporter 76 is conveyed to the side surface of the fourth safe 50*d*. Thereafter, the bundle is mounted on the elevator 80 by the lift 78 positioned at the upper portion of the safe 50*e*. At this time, the bundle form state of the bundle of bills Po moved to the lifter 78 from the transporter 76 is detected by the sensor 84.

If it is discriminated by the sensor 84 that the bundle form of the bundle of bills Po to be moved to the lifter 78 is out of the regulated form, the lifter 78 and the elevator 80 are moved up to the predetermined position. Then, such discriminated bundle of bills Po is stored to the improper safe 50*e* from the dispensing bundle transporter 76. Sequentially, it is detected by the sensor 50*g* that the bundle of improper bills Po' is stored in the safe 50*e*. Then, the elevator 80 and the lifter 78 are returned to the receiving position for receiving the bundle of the bills Po. Thereafter, the number of the dispensed bills Po is subtracted by 1 by use of a counting mechanism included in the bundling storing section control unit 8*a*. Sequentially, the dispensing operation of the next bills po is repeated. The subtraction by 1 of the number of the dispensed bills Po can be easily obtained by counting a form discrimination signal outputted from the sensor 84, or a lift common to be supplied to the lifter 78 and elevator 80.

At the time when all bundles of proper bills Po are moved to the elevator 80 in accordance with the designation from the operating section 4, a driving device (not shown) is driven, and the elevator 80 is moved up to the dispensing portion 82. As a result, the bills can be dispensed based on a unit of the bundle of bills Po.

More specifically, as shown in FIG. 10, the dispense processing mode is defined by the input from the operating section 4 (STP21). Sequentially, the bases (72*a* to 72*d*) of the safes 50*a* to 50*d* in which the bundle of bills of the kind inputted by the operating section 4 is stored are moved up. Then, the bundle of bills is picked up by the dispensing bundle picking-up elements 70*a* to 70*d* positioned at the upper portion of the safe corresponding to the kind of bills. Then, the picked up the bundle of bills is conveyed to the transporter 76 through the rollers 74*a* to 74*d*. The bundle of bills conveyed to the transporter 76 is moved to the lifter 78. At this time, it is discriminated by the sensor 84, which is provided between the transporter 76 and the lifter 78, whether or not the form of the bundle is within the regulated form (STP22). If it is discriminated in STP 22 that the form of the bundle is within the regulated form (STP22-Y), the bundle sent by the transporter 76 is dropped onto the elevator 80 through the lifter 78 (STP23). At this time, "1" as the number of bundle of bills to be dispensed is counted by a counter (not shown) of the bundling storing section control unit 8*a*. Then, it is discriminated whether or not the number of bundle of bills is conformed to the number of dispensing bundle of bills inputted by the controller 4 (STP24). If the number of bundle of bills is not conformed to the number of dispensing bundle of bills inputted by the controller 4 (STP24-N), steps 22 to 24 are repeated until the number of bundle of bills inputted by the controller 4 is dispensed, that is, the number of bundle of bills set by the counter (not shown) of controller 8*a* is counted. If the number of bundle of bills is conformed to the number of dispensing bundle of bills inputted by the controller 4 (STP24-Y), the elevator 80 is driven, and the predetermined number of bundle of bills is carried to the dispensing portion 82 (STP25).

In the case that it is discriminated that the form of the bundle is out of the regulated form (STP22-N), first the elevator 80 and the lifter 78 are moved to the position where they do not contact the bundle of bills carried by the transporter 76 (i.e., arbitrary position of the dispensing portion 82, see FIG. 5). Second, the cover 50*f* of the improper bill storing safe 50*e* is rotated. Third, the bundle of bills whose form is out of regulated form being transported at present by the transporter 76 is dropped onto the improper bill storing safe 50*e*. And, fourth, the elevator 80 and the lifter 78 are returned to the standby position, that is, the position where the bundle of bills carried by the transporter 76 can be received (see FIG. 9) (STP26). In this case, since the bundle of bills being transported at present by the transporter 76 is dropped onto the improper bill storing safe 50*e*, the number of bundles to be moved to the dispensing portion 82 by the elevator 80 is "1" short. Therefore, the counter of the controller 8*a* is subtracted by 1 (it is not counted as a dispensing bundle of bills). Then, STPs 22 to 24 are repeated until the number of bundles inputted by the controller 4 is dispensed. At the time when the dispensed number of bundle of bills is conformed to the number of dispensing bundle of bills inputted by the controller 4 (STP24-Y), the elevator 80 is driven, and the predetermined number of bundle of bills is transported to the dispensing portion 82 (STP25).

As explained above, according to the bill processing apparatus of the present invention, it is discriminated whether or not the bills to be bundled are proper bills or improper bills. Then, if the bills to be bundled are proper bills, it is discriminated whether or not that the form of the bundle of bills bundled by the predetermined number is within the regulated form, and only the bundle whose form is within the regulated form is stored in proper bill storing safe of the storage device. The bundle of improper bills, which is not dispensed, is sorted, and stored therein. Even in a case that the bundle, which is once stored in each safe as a proper bundle, is dispensed, the form of the bundle of the bills is checked again, and only the bundle of the proper bills whose form is within the regulated form is dispensed. Therefore, the apparatus can be prevented from being jammed with the bundle of bills whose form is defective when dispensing the bills.

On the other hand, even in a case that the bundle of improper bills and the bundle whose form is insufficient are stored in the same safe, since the mark showing the improper bills is printed onto the binding tape, the bundle of bills whose form is insufficient and the bundle of improper bills can be easily distinguished, and the processing count time can be reduced.

Moreover, in a case that the predetermined proper bill storing safe is fulled with proper bills, even proper bills can be stored in the improper bill storing safe. Therefore, the space of the storing safe of the apparatus can be prevented from being increased, and the small-sized bill processing apparatus can be provided.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A bill processing apparatus, comprising:

means for picking up bills one by one;

means for discriminating what kind of bill is picked up by the picking up means and a degree of damage, in any, of the bill;

stacking means for sorting the bills discriminated by the discriminating means in accordance with the degree of damage of the bills to distinguish proper bills for dispensing from improper bills not to be reused;

bundling means for bundling bills stacked by the stacking means when a predetermined number of bills have accumulated;

first bundle form detecting means for detecting a form of a bundle of proper bills bundled by the bundling means;

a plurality of safes for storing bundles of proper bills by kind of bills whose form is detected to be consistent with a predetermined form by the first bundle form detecting means;

means for storing a bundle of improper bills and a bundle of proper bills whose form is detected to be inconsistent with the predetermined form by the first bundle form detecting means separately from other bundles whose form is consistent with the predetermined form;

means for dispensing a bundle of proper bills from the safe;

second bundle form detecting means for detecting a form of the bundle of proper bills dispensed by the dispensing means;

receiving and transporting means for receiving the bundle of the proper bills dispensed by the dispensing means and detected as a normal form by the second bundle form detecting means, and for transporting the bundle of proper bills to a predetermined position; and means for controlling to store the bundle of proper bills in the storing means when the form of the bundle of proper bills dispensed by the dispensing means is detected to be inconsistent with the predetermined form by the second bundle form detecting means.

2. The apparatus according to claim 1, further comprising:

transporting means, provided at an inlet/outlet of each safe to be opened/closed, for introducing a bundle of bills being delivered into the corresponding safe when the kind of the bundle of bills being delivered conforms to the corresponding safe and its form is detected to be consistent with the predetermined form by the first form detecting means, and for guiding the bundle of bills being delivered to the storing means when the form of the bundle of bills being delivered is detected to be inconsistent with the predetermined form by the first form detecting means.

3. A bill processing apparatus wherein bills sorted by a predetermined number are bundled and the bundled bills can be dispensed, comprising:

means for holding bills to be sorted;

means for picking up the bills held on said holding means one by one;

means for discriminating damage of the bill picked up by said picking up means and a kind of the bill;

first stacking means for stacking the bill or proper bill discriminated to be suitable for a next use at a market by said discriminating means;

second stacking means for stacking the bill or improper bill discriminated to be unsuitable for a next use at a market by said discriminating means;

means for bundling the bills stacked in each of said first and second stacking means when the bills reaches to a predetermined number of bills;

first bundle form detecting means for detecting a form of bundle of proper bills bundled by the predetermined number by said bundling means;

a plurality of safes for storing the bundle of proper bills by kind of bills whose form is detected to be within the regulated form by said first bundle form detecting means;

means for storing the bundle of improper bills and a bundle of proper bills whose the form is detected to be out of the regulated form by said first bundle form detecting means separately from the other bundle whose form is within the regulated form;

means for dispensing the bundle of the proper bill from said safe to be dispensed;

second bundle form detecting means for detecting the form of the bundle of the proper bill dispensed by said dispensing means;

transporting means, provided at inlet/outlet of each of said safes to be opened/closed, for introducing the bundle of bills being delivered at present into the corresponding safe when the kind of the bundle of bills being delivered at present is conformed to each of said safes and the form is detected to be within the regulated form by said first form detecting means, and for guiding the bundle of bills being delivered at present to said storing means when the form of the bundle of bills being delivered at present is detected to be out of the regulated form by said first form detecting means; and receiving means for receiving the bundle of the proper bills dispensed by said dispensing means and detected as a normal form by said second bundle form detecting means; and control means for driving said transporting means to each of the bundles of bills is dropped into said storing means when the bundle of bills bundled by said bundling means is a bundle of improper bills, the form of the bundle of the bills transported to said plurality of safes is detected to be out of the regulated form by said first form detecting means, and the form of the bundle of bills transported to said receiving means from said plurality of safes is detected to be out of the regulated form by said second form detecting means, and for transporting a next bundle of bills to said receiving means from said one of plurality of safes when the bundle of the bills dropped into said storing means is a bundle transported to said receiving means from one of said plurality of safes.

* * * * *